US011692700B2

(12) United States Patent
Li et al.

(10) Patent No.: US 11,692,700 B2
(45) Date of Patent: Jul. 4, 2023

(54) WATERPROOF LED BAR LAMP BULB

(71) Applicant: Sichuan Jamie Charming Technology Co.,Ltd., Nanchong (CN)

(72) Inventors: Min Li, Nanchong (CN); Xin Zhang, Nanchong (CN); Yanhong Gui, Nanchong (CN)

(73) Assignee: Sichuan Jamie Charming Technology Co., Ltd., Nanchong (CN)

( * ) Notice: Subject to any disclaimer, the term of this patent is extended or adjusted under 35 U.S.C. 154(b) by 0 days.

(21) Appl. No.: 17/989,701

(22) Filed: Nov. 18, 2022

(65) Prior Publication Data

US 2023/0082893 A1 Mar. 16, 2023

(30) Foreign Application Priority Data

Oct. 27, 2022 (CN) ..... 202222865208.2

(51) Int. Cl.

| | |
|---|---|
| ***F21V 31/00*** | (2006.01) |
| ***F21S 4/28*** | (2016.01) |
| ***F21Y 103/10*** | (2016.01) |
| ***F21Y 115/10*** | (2016.01) |

(52) U.S. Cl.

CPC ..... *F21V 31/005* (2013.01); *F21S 4/28* (2016.01); *F21Y 2103/10* (2016.08); *F21Y 2115/10* (2016.08)

(58) Field of Classification Search

CPC ..... F21V 31/005; F21S 4/28; F21Y 2103/10; F21Y 2115/10

See application file for complete search history.

(56) References Cited

U.S. PATENT DOCUMENTS

| | | | | |
|---|---|---|---|---|
| 10,533,738 | B2 * | 1/2020 | Leung | F21V 23/001 |
| 10,718,470 | B1 * | 7/2020 | Wu | F21V 31/005 |
| 10,718,471 | B1 * | 7/2020 | Wu | F21K 9/238 |
| 10,753,595 | B1 * | 8/2020 | Wan | F21V 3/02 |
| 11,125,430 | B1 * | 9/2021 | Wu | F21V 17/12 |
| 11,215,327 | B1 * | 1/2022 | Wang | F21K 9/232 |
| 11,293,596 | B1 * | 4/2022 | Wang | F21K 9/238 |
| 11,293,599 | B1 * | 4/2022 | Wang | F21V 31/005 |
| 11,543,085 | B1 * | 1/2023 | Lei | F21K 9/232 |
| 2006/0215422 | A1 * | 9/2006 | Laizure | F21K 9/232 362/267 |
| 2009/0237930 | A1 | 9/2009 | Li | |
| 2010/0073963 | A1 | 3/2010 | Yu | |
| 2015/0103535 | A1 | 4/2015 | Hu | |
| 2017/0292692 | A1 * | 10/2017 | Chen | F21V 23/006 |
| 2018/0372277 | A1 * | 12/2018 | Zhang | F21V 17/002 |
| 2018/0372278 | A1 * | 12/2018 | Zhang | F21K 9/237 |
| 2021/0388952 | A1 * | 12/2021 | Wan | F21K 9/66 |

* cited by examiner

*Primary Examiner* — Tsion Tumebo
(74) *Attorney, Agent, or Firm* — Zhigang Ma

(57) ABSTRACT

A waterproof light-emitting diode (LED) bar lamp bulb, including a lamp base and a shell connected with the lamp base, and further including a stem assembly; the stem assembly is connected to an opening portion of the shell; the stem assembly includes a rubber seat, and a first metal wire, an LED bar, and a second metal wire which are electrically connected with each other in sequence; the rubber seat is matched with the opening portion of the shell; a filling recess is formed by the rubber seat and the opening portion of the shell; and a sealant layer for sealing and waterproofing is arranged at the filling recess.

8 Claims, 7 Drawing Sheets

WATERPROOF LED BAR LAMP BULB

TECHNICAL FIELD

The present disclosure relates to the technical field of lamp bulbs, in particular, to a waterproof light-emitting diode (LED) bar lamp bulb.

BACKGROUND

With the popularity of electricity, lamps have entered thousands of households. People are no longer limited to using lamps for general lighting, but are more inclined to use lamps to create different atmospheres. For example, in a party, lamp bulbs with different light colors are made into light strings which are then fixed to artificial trees, walls, fences, indoor ceilings and other places to decorate the environment, set off the party's atmosphere and add the artistic effect.

Chinese patent CN 212746038 U discloses a waterproof solder-free LED lamp bulb, including a fixed structure and a waterproof structure. The fixed structure is, composed of a rivet and a female terminal. A top of the rivet is provided with an anti-skid clamping position, and both sides of the female terminal are provided with movable locking lugs. The waterproof structure is composed of a waterproof ring and a silica gel plug. A hole is formed in a middle portion of the silica gel plug. The rivet is arranged in the hole of the silica gel plug in a penetrating manner. The anti-skid clamping position is exposed from the other end of the hole and is clamped with the female terminal. This patent uses the silica gel plug and the waterproof ring to seal an opening portion of a shell to improve the waterproof performance of the lamp bulb, but this method still cannot completely solve the problem of bulb water seepage, and the waterproof performance of the lamp bulb still needs to be improved. In view of this, the inventor has made a new invention.

SUMMARY

For the shortcomings in the prior art, the present disclosure aims to provide a waterproof LED bar lamp bulb which features with high waterproof performance.

In, order to achieve the above objective, the present disclosure provides a waterproof LED bar lamp bulb, including a lamp base and a shell connected with the lamp base, and further including a stem assembly. The stem assembly is connected to an opening portion of the shell. The stem assembly includes a rubber seat, and a first metal wire, an LED bar and a second metal wire which are electrically connected with each other in sequence. The rubber seat is matched with the opening portion of the shell. A filling recess is formed by the rubber seat and the opening portion of the shell. A sealant layer for sealing and waterproofing is arranged at the filling recess. The LED bar is located at a top of the rubber seat and extends into the shell. The rubber seat is also provided with at least two accommodating holes that metal wires pass through. One end of the first metal wire and one end of the second metal wire are both electrically connected to the LED bar through the accommodating holes, and the other ends are electrically connected to the lamp base.

Preferably, the rubber seat includes a cylindrical portion connected to the opening portion of the shell. The accommodating holes are formed in the cylindrical portion. An upper end of the cylindrical portion is provided with a supporting portion. The LED bar is arranged above the supporting portion.

Preferably, the cylindrical portion is provided with a first space, and the supporting portion is provided with a second space.

Preferably, the supporting portion is U-shaped. The first metal wire and the second metal wire respectively pass through two side arms of the U-shaped supporting portion.

Preferably, inclined guide portions are arranged at outer ends of the two side arms of the U-shaped supporting portion.

Preferably, the cylindrical portion is provided with an assembling slope or the opening portion of the shell is provided with an assembling slope.

Preferably, at least two elastic abutting portions capable of abutting against the opening portion of the shell are symmetrically arranged at a periphery of the cylindrical portion.

Preferably, a clamping portion clamped with an end opening of the shell also extends from each elastic abutting portion.

Preferably, the first metal wire is electrically connected with a resistor a. The resistor a is arranged in the accommodating hole and is filled and fixed with the sealant layer.

Even further, the sealant layer is flush with, the end opening of the shell.

Beneficial effects: Compared with the prior art, the present disclosure discloses a waterproof LED bar lamp bulb, including a lamp base and a shell connected with the lamp base, and further including a stem assembly; the stem assembly is connected to an opening portion of the shell; the stem assembly includes a rubber seat, and a first metal wire, an LED bar, and a second metal wire which are electrically connected with each other in sequence; the rubber seat is matched with the opening portion of the shell; a filling recess is formed by the rubber seat and the opening portion of the shell; and a sealant layer for sealing and waterproofing is arranged at the filling recess. The present disclosure has the following advantages: 1, sealed isolation type waterproofing for the lamp bulb is achieved, and the waterproof performance of the lamp bulb is greatly improved; 2, the lamp bulb has a simple structure, and can achieve high waterproof performance of the lamp bulb without increasing the production cost of the lamp bulb; and 3, a U-shaped top of the rubber seat effectively saves raw material.

Figure 1:
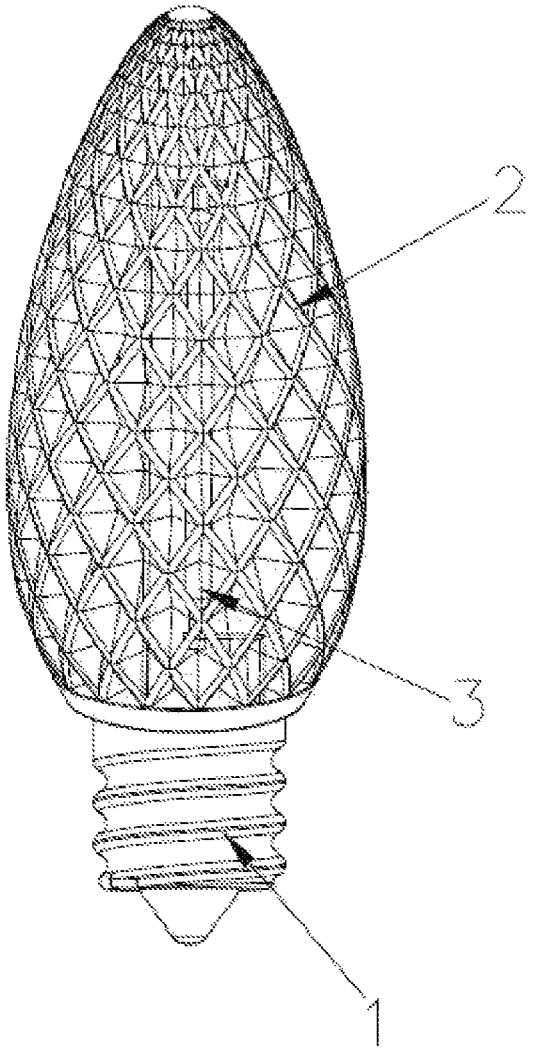
FIG. 1 is a schematic three-dimensional diagram of the present disclosure.
Figure 2:
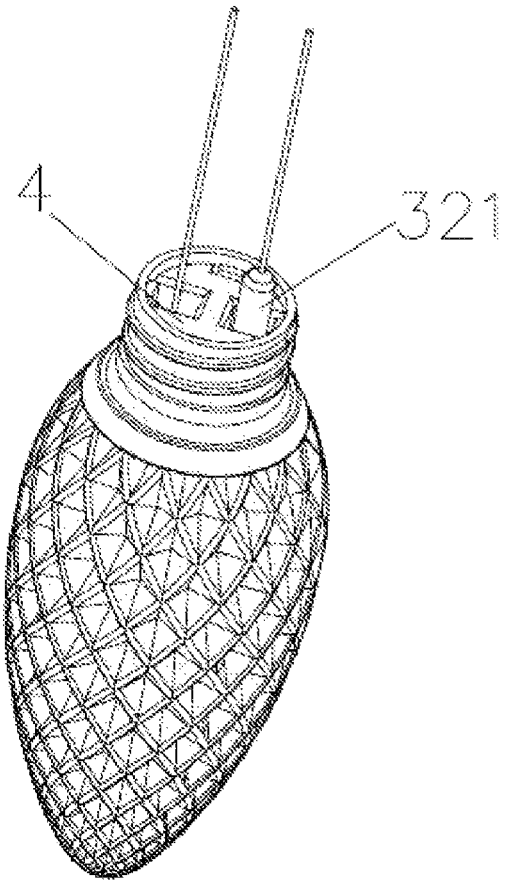
FIG. 2 is a schematic structural diagram of a filling recess of the present disclosure.

Reference numerals include:

1: lamp base; 2: shell; 3: stem assembly; 31: rubber seat; 311: cylindrical portion; 312: supporting portion; 313: first space; 314: second space; 315: inclined guide portion; 316: elastic abutting portion; 317: clamping portion; 318: assembling slope; 319: rib; 32: first metal wire; 321: resistor a: 33: LED bar; 34: second metal wire; 35: accommodating hole; 4: filling recess; and 41: sealant layer.

DETAILED DESCRIPTION OF THE EMBODIMENTS

The present disclosure is described in detail below in combination of FIG. 1-FIG. 7.

Figure 4:
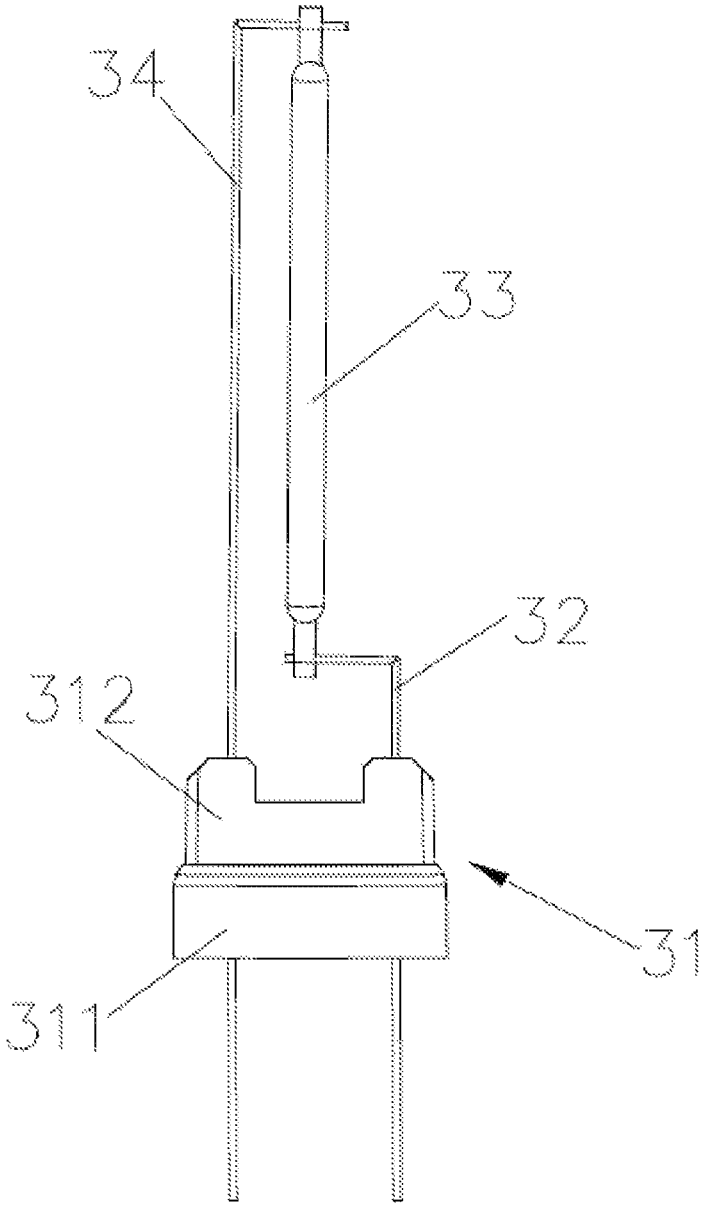
FIG. 4 is a schematic structural diagram of a stem assembly of the present disclosure.

The present disclosure discloses a waterproof LED bar lamp bulb, including a lamp base 1 and a shell 2 connected with the lamp base 1, and further including a stem assembly 3. The stem assembly 3 is connected to an opening portion of the shell 2. The stem assembly 3 includes a rubber seat 31, and a first metal wire 32, an LED bar 33 and a second metal wire 34 which are electrically connected with each other in sequence. The rubber seat 31 is matched with the opening portion of the shell 2. A filling recess 4 is formed by the rubber seat 31 and the opening portion of the shell 2. A sealant layer 41 for sealing and waterproofing is arranged at the filling recess 4. The LED bar 33 is located at a top of the rubber seat 31 and extends into the shell 2. The rubber seat 31 is also provided with at least, two accommodating holes 35 that metal wires pass through. One end of the first metal wire 32 and one end of the second metal wire 34 are both electrically connected to the LED bar 33 through the accommodating holes 35, and the other ends are electrically connected to the lamp base 1. The electrical connection here refers to that the first metal wire 32 and the second metal wire 34 are electrically connected to positive and negative connection poles of the lamp base 1 respectively. In this technical solution, as shown in FIG. 4, the first metal wire 32 and the second metal wire 34 have a supporting effect on the LED bar 33. The first metal wire 32 and the second metal wire 34 can be fixed in the accommodating holes 35. The number of the accommodating holes 35 of the rubber sea 31 can correspondingly increase when there is more than one LED bar 33 connected.

In the present disclosure, the stem assembly 3 is provided with the rubber seat 31, and the rubber seat 31 is matched with the opening portion of the shell 2. The rubber seat 31 is used to seal the opening portion of the shell 2, which improves the waterproof performance of the lamp bulb. Based on this, the inventor further makes use of the rubber seat 31 and the opening portion of the shell 2 to form the filling recess 4, and the filling recess 4 is filled with the sealant layer 41, so as to seal the inside of the lamp bulb and completely isolate the inside from an external environment. Therefore, the lamp bulb has better waterproof performance, and the service life of the lamp bulb is effectively prolonged. In, another aspect, the entire lamp bulb has a simple structure and low production cost, and is more in line with the existing production requirements.

Figure 7:
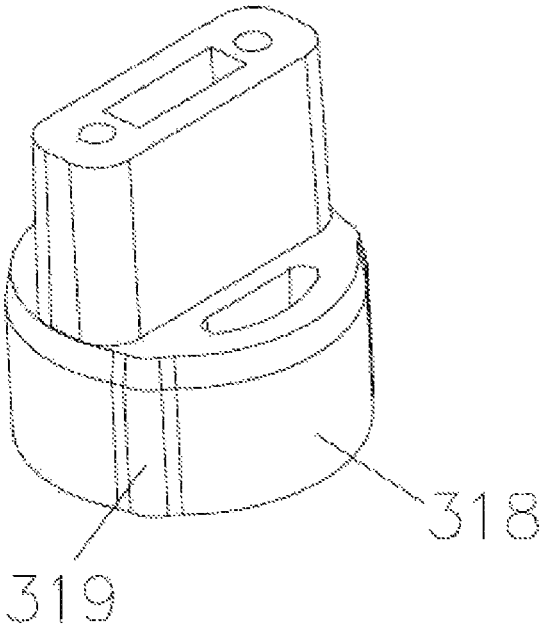
FIG. 7 is a schematic structural diagram of an assembling slope of the present disclosure.

Preferably, the rubber seat 31 includes a cylindrical portion 311 connected to the opening portion of the shell 2. The accommodating holes 35 are formed in the cylindrical portion 311. An upper end of the cylindrical portion 311 is provided with a supporting, portion 312. As shown in FIG. 7, the LED bar 33 is arranged above the supporting portion 312.

In this technical solution, the supporting portion 312 is U-shaped. The U-shaped supporting portion 312 can effectively save materials of the rubber seat 31 and reduce the production cost. Meanwhile, to define the positions of the first metal wire 32 and the second metal wire 34, the first metal wire 32 and the second metal wire 34 respectively pass through two side arms of the U-shaped supporting portion 312.

As a preference, the cylindrical portion 311 is provided with a first space 313, and the supporting portion 312 is provided with a second space 314. The first space 313 and the second space 314 can both the raw materials of the rubber seat 31 and reduce the production cost, and the second space 314 is also reserved for clamping and fixing a lamp panel.

In a further improved technical solution, inclined guide portions 315 are arranged at outer ends of the two side arms of the U-shaped supporting portion 312. In a process of using automatic equipment to assemble the rubber seat 31 to the opening portion of the shell 2, when the rubber seat 31 has a slight deviation in its position, the inclined portions can guide the rubber seat 31 to be assembled into the shell 2, so that the rubber seat 31 can still be successfully assembled, and the assembling efficiency of the rubber seat 31 is improved.

As a preference, the cylindrical portion 311 is provided with an assembling slope 318 or the opening portion of the shell 2 is provided with an assembling slope 318. When the cylindrical portion 311 is provided with the assembling slope 318, as shown in FIG. 7, the slope is added to the periphery of the cylindrical portion 311 to form a truncated cone shape, which is convenient for being clamped with the opening portion of the shell 2 to fix the rubber seat 31, so that the assembling efficiency for the shell 2 and the rubber seat 31 is higher. Similarly, the assembling slope 318 can also be arranged at the opening portion of the shell 2, so that the opening portion of the shell 2 is made into a truncated cone shaped opening to achieve the same technical effect above. Further, as shown in FIG. 7, ribs 319 can also be added on the assembling slope 318, so that the cylindrical portion 311 can be further closely connected to the opening portion of the shell 2.

Figure 5:
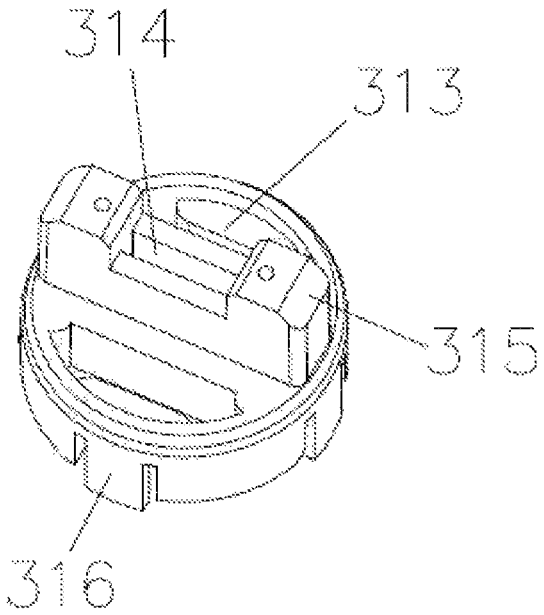
FIG. 5 is a schematic structural diagram of another embodiment of the rubber seat of the present disclosure.

In another embodiment, as shown in FIG. 5, at least two elastic abutting portions 316 capable of abutting against the opening portion of the shell 2 are symmetrically arranged at the periphery of the cylindrical portion 311. When the shell 2 and the rubber seat 31 are assembled, the elastic abutting portions 316 can effectively buffer a pressure between the cylindrical portion 311 and the opening portion of the shell 2. For example, when a pressure from the shell 2 to the rubber seat 31 too high, the elastic abutting portions 316 are stressed to inwards retract, which is favorable for assembling the shell 2 and the rubber seat 31 and can also prevent the rubber seat 31 from being damaged, so that the yield and production efficiency of the lamp bulb are improved.

Figure 6:
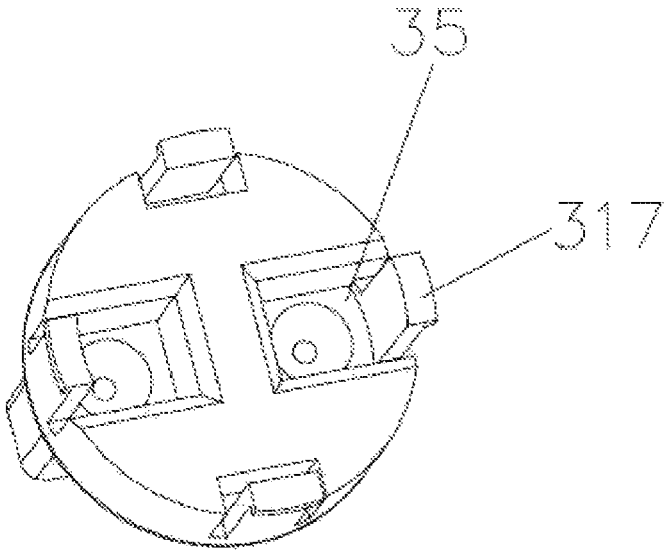
FIG. 6 is a schematic structural diagram of still another embodiment of the rubber seat of the present disclosure.

In still another embodiment, as shown in FIG. 6, based on the optimal arrangement of the elastic abutting portions 316 on the cylindrical portion 311, the inventor further makes the elastic abutting portions 316 extend to form clamping portions 317. When the rubber seat 31 is assembled into the shell 2, the clamping portions 317 at a tail end of the rubber seat 31 can be clamped with an end opening of the shell 2 to further stabilize the connection between the rubber seat 31 and the shell 2 and improve the stability of the whole lamp bulb.

Figure 3:
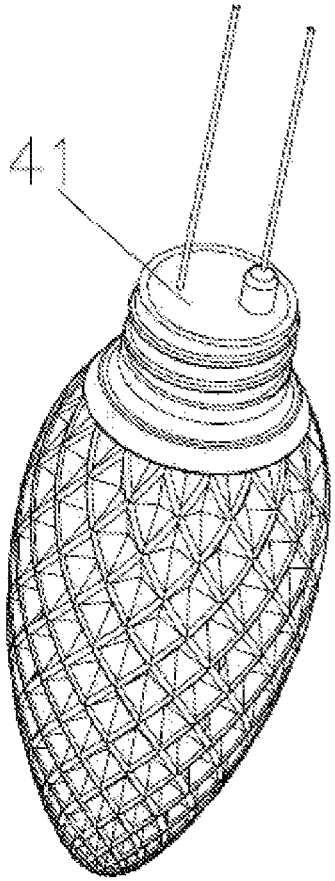
FIG. 3 is a schematic structural diagram of a sealant layer of the present disclosure.

As a preference, the first metal wire 32 is electrically connected with a resistor a 321. The resistor a 321 is arranged in the accommodating hole 35 and is packaged by the sealant layer 41. The resistor a 321 of this technical solution is arranged at a middle portion of the first metal, wire 32. A main function of the resistor a 321 is to prevent the stem assembly 3 from being damaged by an extremely high short-circuit current in the lamp bulb, and the resistor a achieves a current limiting effect. The resistor a can also achieve a heat dissipation effect if the lamp bulb is used constantly and generate a high temperature. Of course, to achieve better current limiting and heat dissipation effects, the second metal wire 34 can also be correspondingly connected to a resistor. When the lamp bulb is filled with the sealant layer 41 after the metal wire is connected to the resistor, the accommodating holes 35 are also packaged together. The resistor is completely packaged and fixed in the accommodating hole 35 or the sealant layer 41 is partially exposed as shown in FIG. 3.

In this technical solution, when the rubber seat 31 is made of a soft rubber material, the accommodating holes 35 are blind holes that can be punctured by wires. That is, tops of the accommodating holes 35 are sealed to further prevent water and fog from entering the shell 2 through the accommodating holes 35. There is also a function of fixing the first metal wire 32 and the second metal wire 34. In addition, in order to match the installation of the resistor, the top ends of the accommodating holes 35 are conical, so that the top end of the resistor can be better fixed, which is convenient for subsequently gluing and packaging the resistor.

In the manufacturing process of the lamp bulb, the inventor can further control the height of the sealant layer 41 to be just flush with the end opening of the shell 2, which avoids a waste of materials caused by spilling and can also avoid the impact of the sealant layer 41 on the electrical connection between the shell 2 and the lamp base 1.

The above contents are only preferred embodiments of the present disclosure. Those of ordinary skill in the art can make changes to the specific implementations and application scopes according to the idea of the present disclosure, and the contents of this specification shall not be understood as restrictions to the present disclosure.

What is claimed is:

1. A waterproof light-emitting diode (LED) bar lamp bulb, comprising a lamp base (1) and a shell (2) connected with the lamp base (1), and further comprising a stem assembly (3), wherein the stem assembly (3) is connected to an opening portion of the shell (2); the stem assembly (3) comprises a rubber seat (31), and a first metal wire (32), an LED bar (33) and a second metal wire (34) which are electrically connected with each other in sequence; the rubber seat (31) is matched with the opening portion of the shell (2); a filling recess (4) is formed by the rubber seat (31) and the opening portion of the shell (2); a sealant layer (41) for sealing and waterproofing is arranged at the filling recess (4); the LED bar (33) is located at a top of the rubber seat (31) and extends into the shell (2); the rubber seat (31) is also provided with at least two accommodating holes (35) that metal wires pass through; and one end of the first metal wire (32) and one end of the second metal wire (34) are both electrically connected to the LED bar (33) through the accommodating holes (35), and the other ends are electrically connected to the lamp base (1);

wherein the rubber seat (31) comprises a cylindrical portion (311) connected to the opening portion of the shell (2); the accommodating holes (35) are formed in the cylindrical portion (311); an upper end of the cylindrical portion (311) is provided with a supporting portion (312); and the LED bar (33) is arranged above the supporting portion (312);

the cylindrical portion (311) is provided with an assembling slope (318) or the opening portion of the shell (2) is provided with an assembling slope (318); the assembling slope allows the cylindrical portion (311) to form a truncated cone shape.

2. The waterproof LED bar lamp bulb according to claim 1, wherein the cylindrical portion (311) is provided with a first space (313), and the supporting portion (312) is provided with a second space (314).

3. The waterproof LED bar lamp bulb according to claim 1, wherein the supporting portion (312) is U-shaped; and the first metal wire (32) and the second metal wire (34) respectively pass through two side arms of the U-shaped supporting portion (312).

4. The waterproof LED bar lamp bulb according to claim 3, wherein inclined guide portions (315) are arranged at outer ends of the two side arms of the U-shaped supporting portion (312).

5. The waterproof LED bar lamp bulb according to claim 1, wherein at least two elastic abutting portions (316) capable of abutting against the opening portion of the shell (2) are symmetrically arranged at a periphery of the cylindrical portion (311), allowing to buffer a pressure between the cylindrical portion (311) and the opening portion of the shell (2); the at least two elastic abutting portions (316) are capable of being inward retracted under the pressure between the cylindrical portion (311) and the opening portion of the shell (2).

6. The waterproof LED bar lamp bulb according to claim 5, wherein a clamping portion (317) clamped with an end opening of the shell (2) also extends from each elastic abutting portion (316).

7. The waterproof LED bar lamp bulb according to claim 1, wherein the first metal wire (32) is electrically connected with a resistor a (321); and the resistor a (321) is arranged in the accommodating hole (35) and is filled and fixed with the sealant layer (41).

8. The waterproof LED bar lamp bulb according to claim 1, wherein the sealant layer (41) is flush with the end opening of the shell (2).

* * * * *